US010122109B1

(12) United States Patent
Hirakawa et al.

(10) Patent No.: US 10,122,109 B1
(45) Date of Patent: Nov. 6, 2018

(54) CONNECTION TERMINAL

(71) Applicant: Yazaki Corporation, Tokyo (JP)

(72) Inventors: Takayoshi Hirakawa, Shizuoka (JP); Yasuhiro Tanaka, Shizuoka (JP); Kengo Machida, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/001,856

(22) Filed: Jun. 6, 2018

(30) Foreign Application Priority Data

Mar. 1, 2018 (JP) ..... 2018-036067

(51) Int. Cl.

| | |
|---|---|
| ***H01R 11/22*** | (2006.01) |
| ***H01R 13/11*** | (2006.01) |
| ***H01R 13/35*** | (2006.01) |
| ***H01R 13/187*** | (2006.01) |
| *H01R 4/18* | (2006.01) |

(52) U.S. Cl.
CPC ..... *H01R 13/113* (2013.01); *H01R 13/187* (2013.01); *H01R 13/35* (2013.01); *H01R 4/185* (2013.01)

(58) Field of Classification Search
CPC .... H01R 13/11; H01R 13/113; H01R 13/187; H01R 13/35; H01R 4/185
USPC ..... 439/851, 852
See application file for complete search history.

(56) References Cited

U.S. PATENT DOCUMENTS

| | | | | |
|---|---|---|---|---|
| 8,142,238 | B2 * | 3/2012 | Heigl | H01R 13/111 439/843 |
| 8,632,356 | B2 * | 1/2014 | Bihrer | H01R 13/18 439/442 |
| 8,821,196 | B2 * | 9/2014 | Blasick | H01R 13/111 439/851 |
| 2014/0017960 | A1 * | 1/2014 | Friedhof | H01R 13/111 439/851 |
| 2015/0207255 | A1 * | 7/2015 | Sugiyama | H01R 13/193 439/852 |

FOREIGN PATENT DOCUMENTS

JP 2016-119292 A 6/2016

* cited by examiner

*Primary Examiner* — Khiem Nguyen
(74) *Attorney, Agent, or Firm* — Kenealy Vaidya LLP

(57) ABSTRACT

A connection terminal includes a conductive terminal main body having a female connection body, and a contact member arranged to oppose an inner circumferential surface of the female connection body in one region of an internal space. A first bulging body and a second bulging body protruding from the inner circumferential surface and electrically connected to a male connection body by sandwiching the male connection body with the contact member are provided in the other region of the internal space. The second bulging body has a first guide portion guiding the male connection body while sliding the male connection body, and a second guide portion guiding the contact member while sliding the contact member. Each of the first and second guide portions is formed in a tapered shape.

4 Claims, 8 Drawing Sheets

CONNECTION TERMINAL

CROSS-REFERENCE TO RELATED APPLICATION(S)

The present application claims priority to and incorporates by reference the entire contents of Japanese Patent Application No. 2018-036067 filed in Japan on Mar. 1, 2018.

BACKGROUND OF THE INVENTION

1. Field of the Invention

The present invention relates to a connection terminal.

2. Description of the Related Art

Conventionally, a connection terminal, which includes a terminal main body having a female connection body provided with a columnar internal space into which a male connection body of a mating male terminal is inserted and a contact member accommodated in the internal space and electrically connected to each of the female connection body and the male connection body, has been known. The female connection body has a contact portion which is electrically connected to the male connection body by sandwiching the male connection body between the female connection body and the contact member. The contact portion bulges from an inner circumferential surface of the female connection body. This connection terminal is disclosed, for example, in Japanese Patent Application Laid-open No. 2016-119292 below.

Meanwhile, the contact member and the male connection body are inserted into the internal space from an opening of the female connection body in this type of connection terminal, and thus, there is a possibility that the contact member and the male connection body abut on the contact portion at the time of the insertion to lower insertion workability.

SUMMARY OF THE INVENTION

Therefore, an object of the present invention is to provide a connection terminal capable of improving insertion workability of a contact member and a male connection body.

In order to achieve the above mentioned object, a connection terminal according to one aspect of the present invention includes a conductive terminal main body that includes a female connection body provided with a columnar internal space into which a male connection body of a mating male terminal is inserted, and a wire connection body to which a conducting portion of an electric wire is electrically connected; and a contact member that is arranged to oppose an inner circumferential surface of the female connection body in one region of the internal space partitioned into two regions along an insertion/removal direction of the male connection body, is electrically connected to the female connection body on the inner circumferential surface of the female connection body, and is electrically connected to the male connection body inserted into the internal space from a first opening of the female connection body, wherein a first bulging body and a second bulging body each of which protrudes from the inner circumferential surface of the female connection body and is electrically connected to the male connection body by sandwiching the male connection body, completely accommodated in the internal space, with the contact member are provided, respectively, on a side of the first opening and a side of a second opening in the other region of the partitioned internal space, the second bulging body has a first guide portion capable of guiding the male connection body while sliding the male connection body in a process of inserting the male connection body into the internal space, and a second guide portion capable of guiding the contact member while sliding the contact member in a process of inserting the contact member into the internal space from the first opening, and each of the first guide portion and the second guide portion is formed in a tapered shape so as to have an interval with respect to the one region of the partitioned internal space that is larger on the first opening side than on the second opening side.

According to another aspect of the present invention, in the connection terminal, it is preferable that the first bulging body and the second bulging body are arranged two by two at intervals in a circumferential direction of the inner circumferential surface of the female connection body.

According to still another aspect of the present invention, in the connection terminal, it is preferable that the contact member includes first and second female-side contact portions which are arranged to be spaced apart from each other in the insertion/removal direction and are electrically connected to the inner circumferential surface of the female connection body, and a male-side contact portion that couples the first and second female-side contact portions and is electrically connected to the male connection body inserted into the internal space.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, embodiments of a connection terminal according to the present invention will be described in detail with reference to the drawings. Incidentally, the present invention is not limited by the present embodiment.

Embodiment

One of embodiments of the connection terminal according to the present invention will be described with reference to FIGS. 1 to 8.

Figure 1:
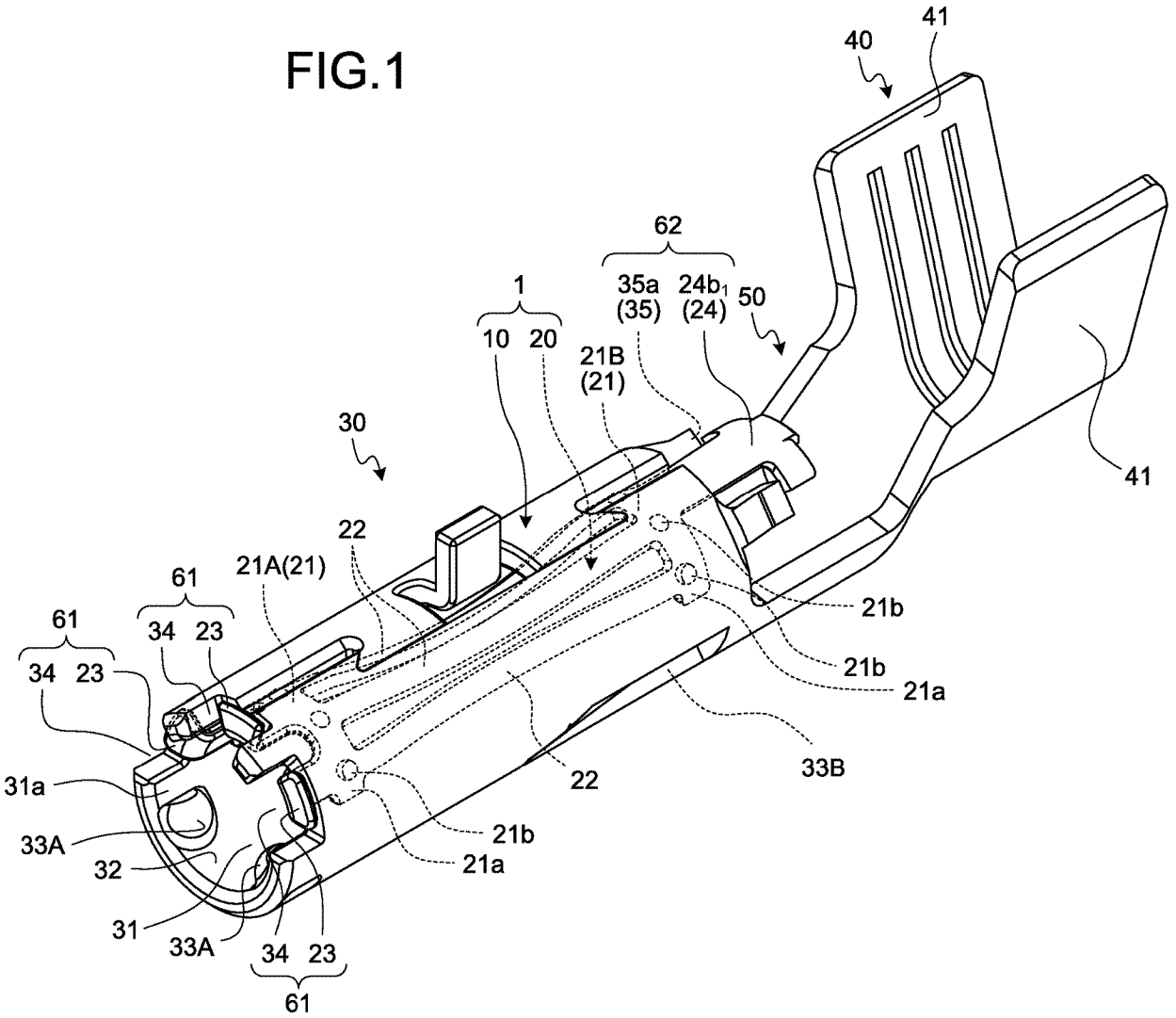
FIG. 1 is a perspective view illustrating a connection terminal according to an embodiment.
Figure 2:
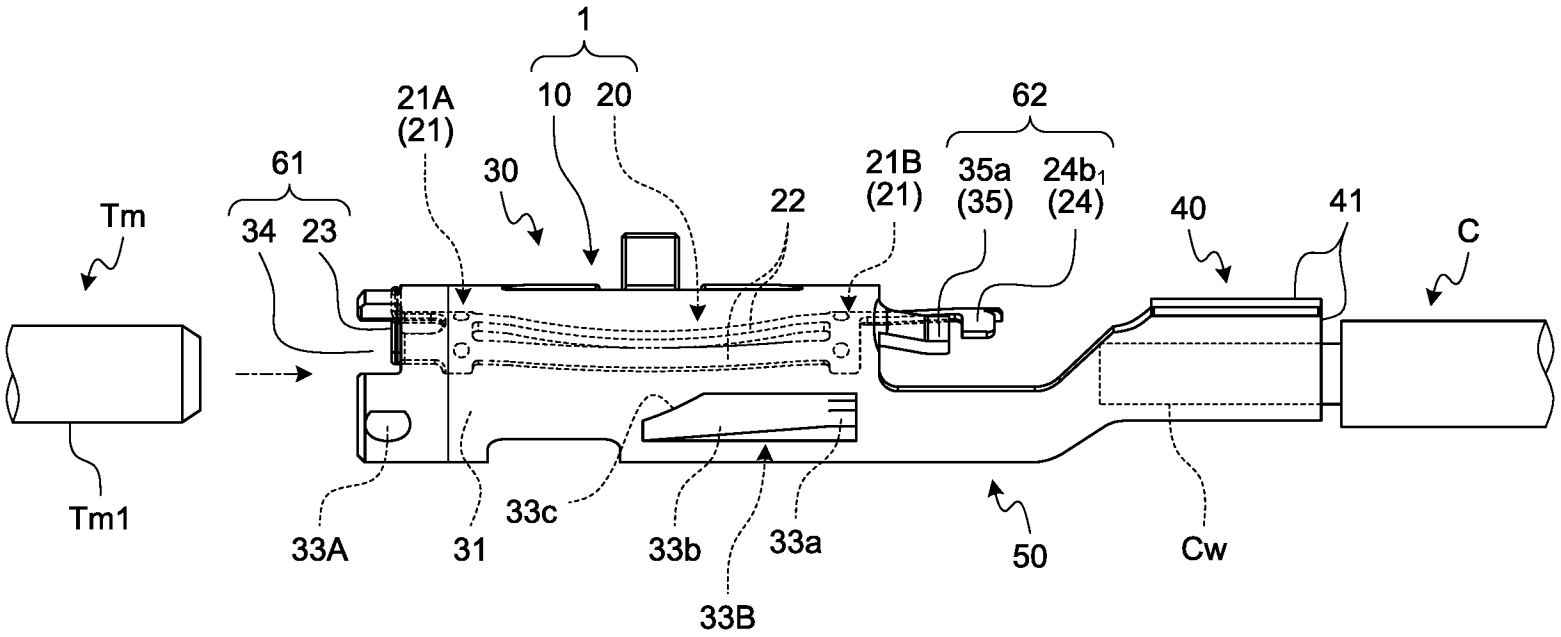
FIG. 2 is a side view illustrating the connection terminal according to the embodiment.

Reference numeral 1 in FIGS. 1 to 6 represents the connection terminal according to the present embodiment. This connection terminal 1 is a so-called female terminal, and is physically and electrically connected to a mating male terminal Tm (FIG. 2). The connection terminal 1 includes a terminal main body 10 and a contact member 20 and is formed by assembling the terminal main body 10 and the contact member 20 with each other.

The terminal main body 10 is made of a conductive material such as metal. The terminal main body 10 in this example is molded by executing a pressing process such as cutting and bending with a conductive metal plate as a base material. The terminal main body 10 includes a female connection body 30, a wire connection body 40, and a coupling body 50.

The female connection body 30 is a part formed in a female type so as to allow a male connection body Tm1 of the male terminal Tm to be inserted therein and is electrically connected to the male connection body Tm1 according to the insertion. Here, an external shape of the female connection body 30 is not limited, but is formed in a tubular shape in accordance with the male connection body Tm1 molded in a columnar shape. The female connection body 30 has an internal space 31 having a shape corresponding to the columnar male connection body Tm1. Both ends of the female connection body 30 in a cylinder axis direction are opened. An opening (hereinafter referred to as a "first opening") 31*a* at one end is used as an opening (male terminal insertion opening) for insertion of the male connection body Tm1 into the internal space 31, and further, is used as an opening (contact member insertion opening) for insertion of the contact member 20 into the internal space 31. In addition, the first opening 31*a* is also used as a removal opening when the male connection body Tm1 is pulled out from the internal space 31. An opening (hereinafter referred to as a "second opening") 31*b* (FIG. 4) at the other end is used to operate a locking structure (second locking structure 62) to be described later.

For example, when the male connection body Tm1 is formed as a plate-shaped bus bar or in a prismatic shape, the female connection body 30 is formed into a square tubular shape having the prismatic internal space 31 corresponding to the shape of the male connection body Tm1. In addition, when the male connection body Tm1 is formed in a cylindrical shape, the female connection body 30 is formed into a cylindrical shape having the cylindrical internal space 31 corresponding to the shape of the male connection body Tm1. In this example, the internal space 31 of the female connection body 30 and the male connection body Tm1 are formed into the columnar shape allowing mutual insertion and removal, and the male connection body Tm1 is inserted into and removed from the internal space 31 along an axis thereof. Here, the plate-shaped base material is processed by bending to mold the female connection body 30 into a cylindrical shape, thereby forming the cylindrical internal space 31 inside of the female connection body 30. Hereinafter, a direction of insertion of the male connection body Tm1 will be referred to as a "male terminal insertion direction" and a direction of removal of the male connection body Tm1 will be referred to as a "male terminal removal direction". In addition, the direction of insertion and removal of the male connection body Tm1 will be referred to as a "male terminal insertion/removal direction".

The electric wire connection body 40 is a part to which a conducting portion Cw (FIG. 2) of an electric wire C is electrically connected. This connection may be of any type, for example, a type obtained by crimping such as caulking, a type obtained by welding, a type obtained by soldering, or the like. The U-shaped wire connection body 40 is formed by bending the plate-shaped base material in this example. The wire connection body 40 has two barrel pieces 41 opposing each other. Each of the barrel pieces 41 is physically and electrically connected to the conducting portion Cw by being wound around a core wire of the electric wire C, which is the conducting portion Cw, and being pressed against the conducting portion Cw.

The coupling body 50 is a part interposed between the female connection body 30 and the wire connection body 40 and couples the female connection body 30 and the wire connection body 40.

The contact member 20 is formed along an inner circumferential surface 32 of the female connection body 30 in the terminal main body 10 and is accommodated in the internal space 31 of the female connection body 30 through the first opening 31*a*. Here, for example, the internal space 31 is partitioned into two regions along the male terminal insertion/removal direction, and the contact member 20 is arranged to oppose the inner circumferential surface 32 of the female connection body 30 in one region of the partitioned internal space 31. The contact member 20 is electrically connected to the female connection body 30 on the inner circumferential surface 32 of the female connection body 30, and is electrically connected to the male connection body Tm1 inserted into the internal space 31 from the first opening 31*a*. The contact member 20 is made of, for example, a conductive material such as metal. The contact member 20 in this example is molded by executing a pressing process such as cutting and bending with a conductive metal plate as a base material. Incidentally, the contact member 20 does not necessarily have conductivity, and any material may be used as long as the material can provide a spring property. This is because the male connection body Tm1 is pressed against a first bulging body 33A and a second bulging body 33B, which will be described later, by the spring property of the contact member 20 in the connection terminal 1 so that it is possible to secure the conductivity between the connection terminal 1 and the male terminal Tm even if the contact member 20 does not have the conductivity. In the following description, it is assumed that the contact member 20 has the conductivity.

Whether the internal space 31 has a cylindrical shape or a prismatic shape, an external shape of the contact member 20 is formed so as to follow the inner circumferential surface 32 of the female connection body 30 in the one region of the internal space 31 as an arrangement place. Since the internal space 31 has the cylindrical shape in this example, the external shape of the contact member 20 is formed such that each position in the axial direction has an arc shape.

Specifically, the contact member 20 has a contact portion (hereinafter referred to as a "female-side contact portion") 21 electrically connected to the inner circumferential surface 32 of the female connection body 30, and a contact portion (hereinafter referred to as a "male-side contact portion") 22 electrically connected to the male connection body Tm1 inserted into the internal space 31.

The female-side contact portion 21 extends along a circumferential direction of the inner circumferential surface 32 of the female connection body 30 in the one region of the internal space 31. Here, the female-side contact portion 21 is formed in an arc shape along the circumferential direction of the inner circumferential surface 32 of the female connection body 30 in order to establish electrical connection in the one region of the internal space 31. The female-side contact portion 21 is arranged such that an arc-shaped outer circumferential surface 21*a* (FIG. 5) opposes the inner circumferential surface 32, and is in contact with the inner circumferential surface 32 of the female connection body 30 on the arc-shaped outer circumferential surface 21*a* side. The female-side contact portion 21 in this example is not only in contact with but also electrically connected to the inner circumferential surface 32 of the female connection body 30 on the arc-shaped outer circumferential surface 21*a* side. A plurality of spherical contact points 21*b* bulging outward in a radial direction is formed on the outer circumferential surface 21*a* in this example. The respective contact points 21*b* are arranged at substantially equal intervals along a circumferential direction of the outer circumferential surface 21*a*. The female-side contact portion 21 is brought into contact with the inner circumferential surface 32 of the female connection body 30 via the respective contact points 21*b*.

The two female-side contact portions 21 are arranged to be spaced apart from each other in the male terminal insertion/removal direction (the cylinder axis direction of the female connection body 30) in the contact member 20 in this example, and the contact member 20 is brought into contact with the female connection body 30 at the two female-side contact portions 21. Here, the two female-side contact portions 21 are used to achieve the electrical connection with the female connection body 30. The female-side contact portions 21 are arranged on the first opening 31*a* side and the second opening 31*b* side, respectively, in the internal space 31. Hereinafter, the female-side contact portion 21 on the first opening 31*a* side will be referred to as a "first female-side contact portion 21A", and the female-side contact portion 21 on the second opening 31*b* side will be referred to as a "second female-side contact portion 21B".

At least one male-side contact portion 22 is arranged between the two adjacent female-side contact portions 21 according to a size, and couples the respective female-side contact portions 21. Here, the four male-side contact portions 22 are provided between the first female-side contact portion 21A and the second female-side contact portion 21B, and each of the male-side contact portions 22 couples the first female-side contact portion 21A and the second female-side contact portion 21B. The male-side contact portion 22 is pushed outward in the radial direction (to the inner circumferential surface 32 side) of the internal space 31 by the male connection body Tm1 inserted into the internal space 31. Since the male-side contact portion 22 is in contact with the male connection body Tm1 at the pushed part (pushed portion), this pushed portion becomes a contact point. The male-side contact portion 22 in this example is not only in contact with but also electrically connected to the male connection body Tm1.

The male-side contact portion 22 is formed so as to have elasticity in the radial direction of the internal space 31 in which the male-side contact portion 22 has been accommodated. That is, the male-side contact portion 22 is formed so as to be capable of deflecting outward in the radial direction at the time of being pushed outward in the radial direction of the internal space 31 by the male connection body Tm1 when the male connection body Tm1 is inserted into the internal space 31. The male-side contact portion 22 in this example is formed like an arc-shaped coupling body that couples the first female-side contact portion 21A and the second female-side contact portion 21B. Here, the male-side contact portion 22 is formed in an arc shape which protrudes to an inner side in the radial direction between the two adjacent female-side contact portions 21 (the first female-side contact portion 21A and the second female-side contact portion 21B), and a vertex part of the protrusion on the inner side in the radial direction becomes the pushed portion as the contact point.

The contact member 20 is inserted into the internal space 31. The insertion may be performed in any form.

Here, the female connection body 30 of the present embodiment is provided with the first bulging body 33A and the second bulging body 33B (FIGS. 1 to 6), which bulge from the inner circumferential surface 32 toward the internal space 31, on the first opening 31*a* side and the second opening 31*b* side, respectively, in the other region of the partitioned internal space 31. The first bulging body 33A and the second bulging body 33B are used, together with the contact member 20, as the contact portions for contact with the male connection body Tm1. The first bulging body 33A and the second bulging body 33B are brought into contact with the male connection body Tm1 for electrical connection with the male connection body Tm1. The first bulging body 33A and the second bulging body 33B are formed and arranged so as to be capable of sandwiching the male connection body Tm1 completely accommodated in the internal space 31 with the male-side contact portion 22 of the contact member 20. The first bulging body 33A and the second bulging body 33B are in contact with the male connection body Tm1 by sandwiching the male connection body Tm1 with the male-side contact portion 22. The first bulging body 33A and the second bulging body 33B are electrically connected to the male connection body Tm1 through the contact. The electrical connection of the male connection body Tm1 with respect to the female connection body 30 is not only indirectly formed via the contact member 20 but also directly formed by the first bulging body 33A and the second bulging body 33B. Incidentally, a holding force of the male connection body Tm1 in the internal space 31 is secured by the contact member 20, the first bulging body 33A, and the second bulging body 33B.

The first bulging body 33A and the second bulging body 33B in this example are arranged two by two at intervals in the circumferential direction of the inner circumferential surface 32 of the female connection body 30. More specifically, the other region of the partitioned internal space 31 is further divided into two regions, and the pair of the first bulging body 33A and the second bulging body 33B is arranged in each of these two divided regions.

The first bulging body 33A is formed to have a spherical surface bulging inward in the radial direction from the inner circumferential surface 32 (FIGS. 1 to 6).

Figure 5:
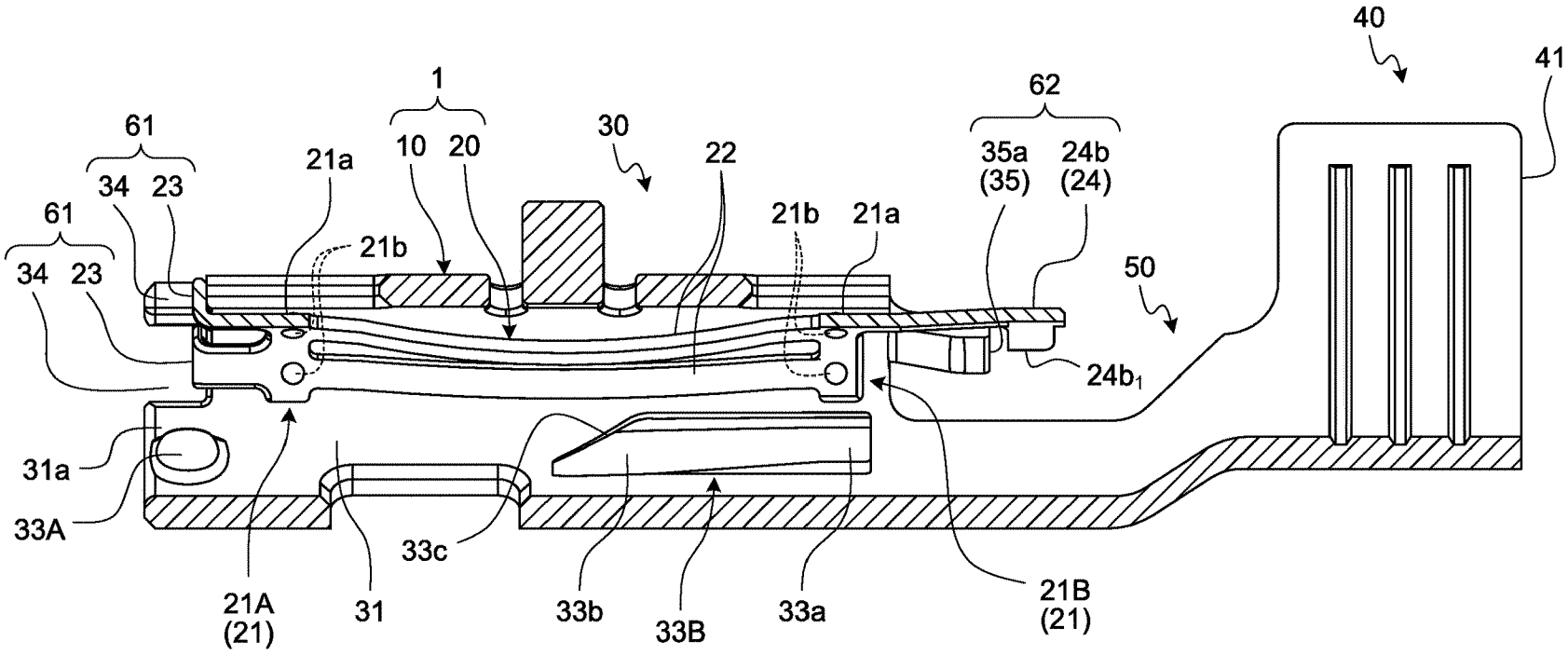
FIG. 5 is a cross-sectional view taken along a line X-X of FIG. 3.
Figure 6:
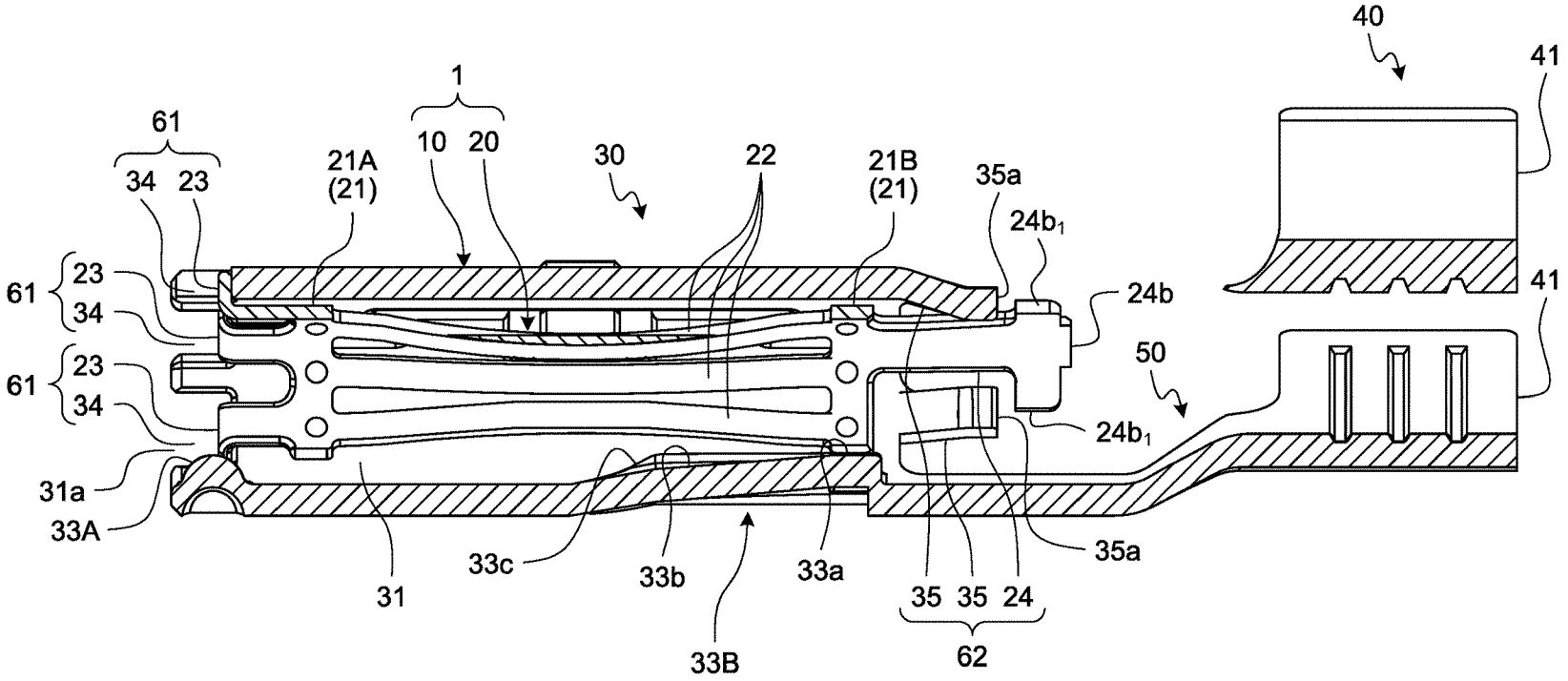
FIG. 6 is a cross-sectional view taken along a line Y-Y of FIG. 3 whose illustration direction is adjusted for the sake of convenience.

The second bulging body 33B has a curved surface bulging inward in the radial direction from the inner circumferential surface 32 and is formed such that the curved surface extends in the cylinder axis direction of the female connection body 30. In the second bulging body 33B, the second opening 31*b* side of the curved surface is used as a contact portion 33*a* with the completely-accommodated male connection body Tm1 (FIGS. 2, 5 and 6). Further, the first opening 31*a* side of the curved surface in the second bulging body 33B is used as a guide portion (hereinafter referred to as a "first guide portion") 33*b* for the male connection body Tm1 (see FIGS. 2, 5 and 6).

The contact portion 33*a* in this example is formed along the cylindrical axis direction of the female connection body 30 and can be in line contact with an outer circumferential surface of the male connection body Tm1.

The first guide portion 33*b* is a part that can guide the male connection body Tm1 while sliding the male connection body Tm1 in the process of inserting the male connection body Tm1 into the internal space 31. The first guide portion 33*b* is formed in a tapered shape such that an interval between the first guide portion 33*b* and the one region of the partitioned internal space 31 is larger on the first opening 31*a* side than on the second opening 31*b* side. The first opening 31*a* side of the first guide portion 33*b* is formed so as to be gently connected to the inner circumferential surface 32 at least in the cylinder axis direction of the female connection body 30. This connecting part is formed such that the male connection body Tm1 smoothly rides on the first guide portion 33*b*. In addition, the second opening 31*b* side of the first guide portion 33*b* is formed so as to be gently connected to the contact portion 33*a* in the cylindrical axis direction of the female connection body 30.

Figure 7:
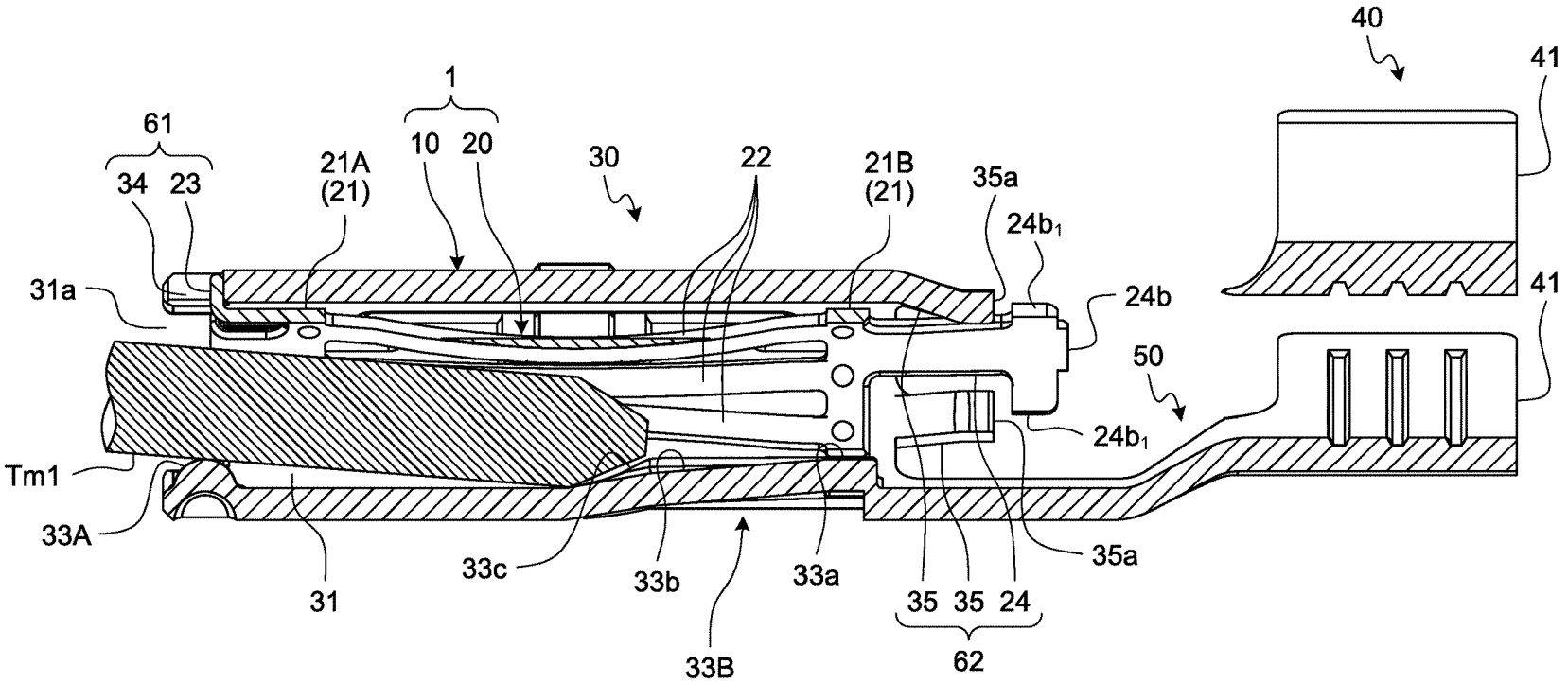
FIG. 7 is a cross-sectional view illustrating a process of inserting a male connection body.
Figure 8:
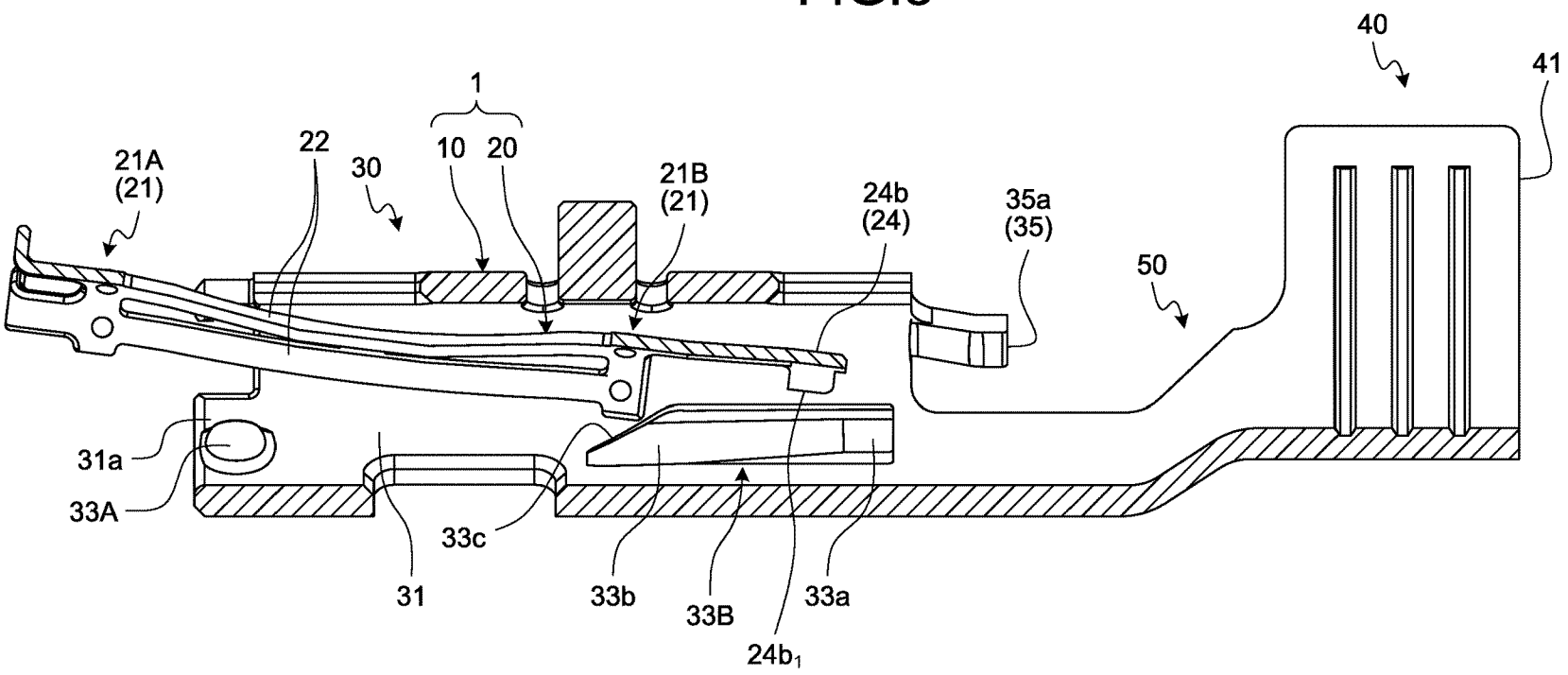
FIG. 8 is a cross-sectional view illustrating a process of inserting a contact member.

For example, when being inserted into the internal space 31, the male connection body Tm1 is likely to tilt with respect to the male terminal insertion direction with the first bulging body 33A as a base point, and a distal end thereof is likely to slide along the inner circumferential surface 32 until reaching a position of the second bulging body 33B (FIG. 7). However, the connection terminal 1 can smoothly guide the male connection body Tm1 to the contact portion 33*a* while sliding the distal end along the first guide portion 33*b* after the distal end of the male connection body Tm1 rides on the first guide portion 33*b* of the second bulging body 33B. Therefore, a force for inserting the male connection body Tm1 is reduced in the connection terminal 1 so that it is possible to improve the insertion workability of the male connection body Tm1.

Here, a tilt angle of the male connection body Tm1 with respect to the male terminal insertion direction decreases as sliding along the first guide portion 33*b*. The male connection body Tm1 is sandwiched between the contact portion 33*a* and the male-side contact portion 22 of the contact member 20 as moving on the contact portion 33*a* from the first guide portion 33*b*.

Further, the second bulging body 33B has a guide portion (hereinafter referred to as a "second guide portion") 33*c* capable of guiding the contact member 20 while sliding the contact member 20 in the process of inserting the contact member 20 into the internal space 31 (FIGS. 2, 5 and 6). The second guide portion 33*c* is formed and arranged so as to guide an end portion in the circumferential direction of the second female-side contact portion 21B. The second guide portions 33*c* guide the end portions in the circumferential direction of the second female-side contact portions 21B, respectively.

The second guide portion 33*c* is formed in a tapered shape such that an interval between the second guide portion 33*c* and the one region of the partitioned internal space 31 is larger on the first opening 31*a* side than on the second opening 31*b* side. The first opening 31*a* side of the second guide portion 33*c* is formed so as to be gently connected to the inner circumferential surface 32 at least in the cylinder axis direction of the female connection body 30. The connecting part is formed such that the contact member 20 smoothly rides on the second guide portion 33*c*. The contact member 20 is guided by the second guide portion 33*c* to a position that enables a piece portion 24$b_1$, which is a locked portion of a second locking structure 62 to be described later, and a locking portion 35*a* to be oppositely arranged in the male terminal insertion/removal direction.

For example, the contact member 20 is in contact with the inner circumferential surface 32 in the one region of the partitioned internal space 31 and is likely to tilt when being inserted into the internal space 31 as described above (FIG. 8). However, when the end portion in the circumferential direction of the second female-side contact portion 21B is in contact with the second guide portion 33*c* of the second bulging body 33B, the connection terminal 1 can smoothly guide the contact member 20 to a guide end position while sliding the end portion along the second guide portion 33*c*. Therefore, it is possible to improve the insertion workability of the contact member 20 and to push back the tilted contact member 20 to a position at which the second locking structure 62 to be described later can function in this connection terminal 1.

Meanwhile, a frictional force or the like acts between the contact member 20 and the male connection body Tm1 when the male connection body Tm1 is inserted into and removed from the internal space 31, and a force corresponding to the frictional force or the like is applied from the male connection body Tm1 along the insertion/removal direction. Thus, if the connection terminal 1 has only the configuration of the present embodiment that has been described so far, there is a risk that the contact member 20 moves relative to the female connection body 30 (the internal space 31) in the insertion/removal direction at the time of inserting or removing the male connection body Tm1. In addition, from this point of view, there is a risk that the contact member 20 moves relative to the female connection body 30 in the axial direction (the same direction as the insertion/removal direction) or the circumferential direction due to input from the outside, such as vibration, at the time of producing the connection terminal 1, at the time of transporting the produced connection terminal 1, or the like even if the above-described force from the male connection body Tm1 is not applied.

Therefore, the connection terminal 1 of the present embodiment is provided with a locking structure capable of locking the contact member 20 in the state of being accommodated in the internal space 31 with respect to the female connection body 30 in order to suppress relative displacement of the contact member 20, which has been completely accommodated in the internal space 31, with respect to the female connection body 30. In the locking structure, the contact member 20 is held at the completely accommodated position in the internal space 31.

The connection terminal 1 is provided with a first locking structure 61 that suppresses the relative displacement of the contact member 20 with respect to the female connection body 30 in the insertion direction. In addition, the connection terminal 1 is provided with the second locking structure 62 that suppresses the relative displacement of the contact member 20 with respect to the female connection body 30 in the removal direction (FIGS. 1, 2, 5, and 6).

First, the first locking structure 61 will be described. The first locking structure 61 is configured to stop the contact member 20 at a predetermined position in the axial direction (the male terminal insertion/removal direction) in the internal space 31 at the time of accommodating the contact member 20 in the internal space 31 and accommodating the male connection body Tm1 in the internal space 31. The predetermined position is a position at which the contact member 20 is completely accommodated in the internal space 31. The first locking structure 61 includes a first locked body 23 provided in the contact member 20 and a first locking body 34 provided in the female connection body 30 to lock movement of the first locked body 23 toward the male terminal insertion direction (FIGS. 1 to 6). The first locking structure 61 includes at least each one of the first locked body 23 and the first locking body 34. For example, a plurality of sets of combinations of one first locked body 23 and one first locking body 34 are provided in the first locking structure 61. Here, three sets are provided at intervals in the circumferential direction.

The first locked body 23 is formed so as to protrude from the contact member 20 toward the inner circumferential surface 32 of the female connection body 30 in the completely accommodated contact member 20. In addition, the first locked body 23 in this example is provided so as to be arranged on the first opening 31*a* side in the internal space 31 in the completely accommodated contact member 20. Here, the first locked body 23 protrudes toward the inner circumferential surface 32 from the end portion on the first opening 31*a* side of the first female-side contact portion 21A. Specifically, the first locked body 23 in this example is formed into a piece shape, and protrudes to the outer side in the radial direction from the end portion on the first opening 31*a* side of the first female-side contact portion 21A.

The movement of the first locked body 23 toward the male terminal insertion direction is locked by the first locking body 34 in order to maintain the accommodated state of the contact member 20 in the internal space 31. The first locking body 34 is a notched body formed at the end portion on the first opening 31*a* side of the female connection body 30, and the first locked body 23 is inserted in the first locking body 34 together with the completion of accommodation of the contact member 20 in the internal space 31. The first locking body 34 has a wall surface on the side in the male terminal insertion direction in the female connection body 30 and locks the movement of the first locked body 23 toward the male terminal insertion direction with this wall surface. In addition, the first locking body 34 has two wall surfaces in the circumferential direction in the female connection body 30 and locks the movement of the first locked body 23 toward the circumferential direction with these respective wall surfaces in the circumferential direction.

The first locked body 23 and the first locking body 34 may be in contact with each other or may be provided with an interval therebetween in the state where the contact member 20 is completely accommodated in the internal space 31. The interval corresponds to a relative movement amount of the first locked body 23 at the completely accommodated position until being locked by the first locking body 34, and is set such that the relative movement amount is within an allowable value. The allowable value may be determined among values of the relative movement amount of the first locked body 23 within a range in which the electrical connection state between the contact member 20 and each of the female connection body 30 and the male connection body Tm1 is not inhibited, and for example, is set to a maximum value of the relative movement amount.

In this manner, the first locking structure 61 can suppress the relative displacement in the insertion direction of the contact member 20 with respect to the female connection body 30, and also suppress the relative displacement in the circumferential direction of the contact member 20 with respect to the female connection body 30.

Next, the second locking structure 62 will be described. The second locking structure 62 is configured to stop the contact member 20 at a predetermined position in the axial direction (the male terminal insertion/removal direction) in the internal space 31 at the time of removing the male connection body Tm1 in the internal space 31 from the first opening 31*a*. The predetermined position is a position at which the contact member 20 is completely accommodated in the internal space 31. The second locking structure 62 includes a second locked body 24 provided in the contact member 20 and a second locking body 35 provided in the female connection body 30 to lock movement of the second locked body 24 toward the male terminal removal direction (FIGS. 1 to 6). The second locking structure 62 includes at least each one of the second locked body 24 and the second locking body 35. Here, one set of a combination of the second locked body 24 and the second locking body 35 is provided.

In the second locking structure 62, the second locked body 24 and the second locking body 35 are formed such that a locked portion of the second locked body 24 (the piece portion 24$b_1$ to be described later) and a locking portion 35*a* of the second locking body 35 are oppositely arranged in the male terminal insertion/removal direction when the contact member 20 has been completely accommodated in the internal space 31 (FIGS. 1 to 6). Incidentally, the second locked body 24 and the second locking body 35 may be formed in the second locking structure 62 such that the second locked body 24 slides along the inner circumferential surface 32 of the female connection body 30 while bending in the process of inserting the contact member 20 into the internal space 31.

Figure 3:
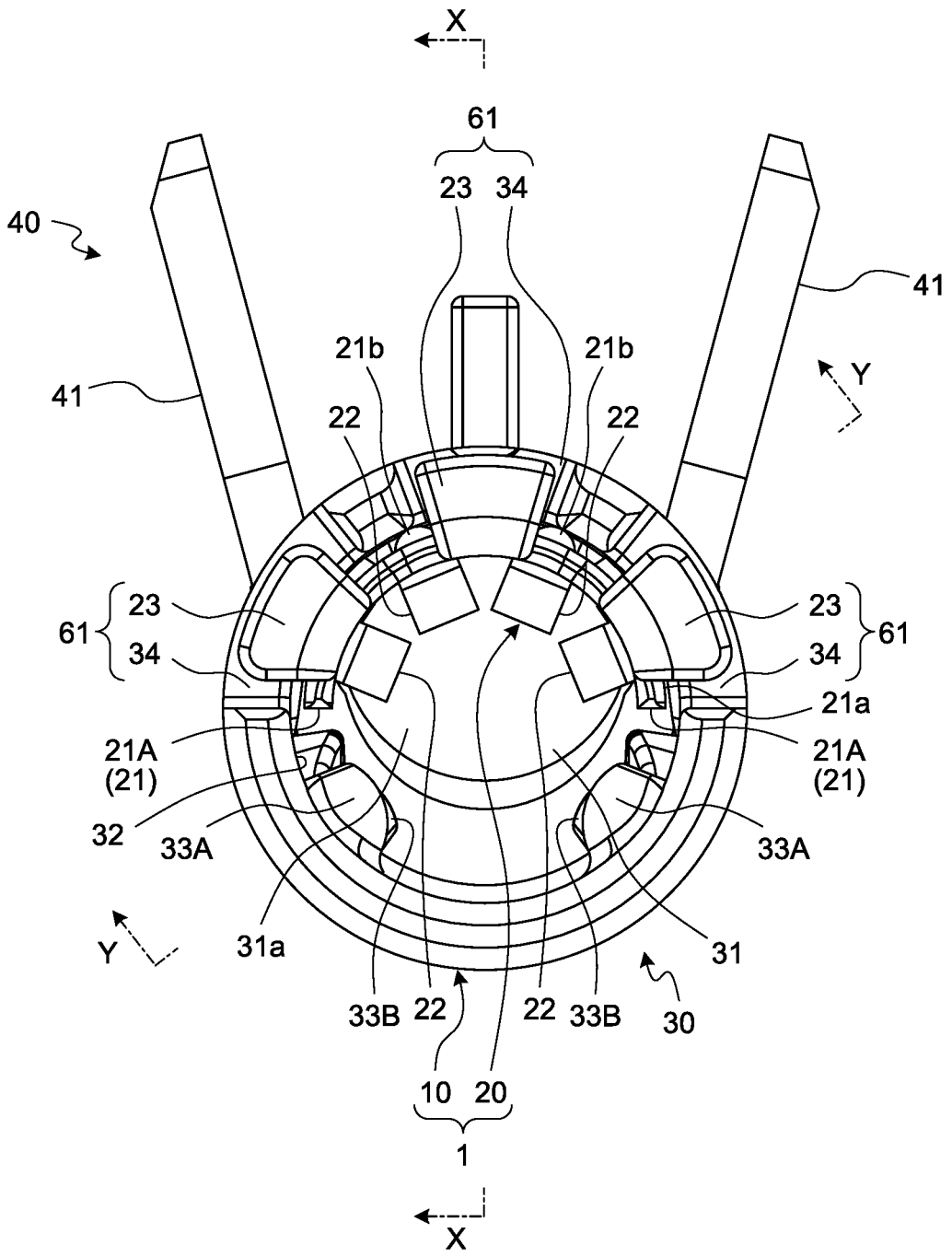
FIG. 3 is a front view illustrating the connection terminal according to the embodiment.
Figure 4:
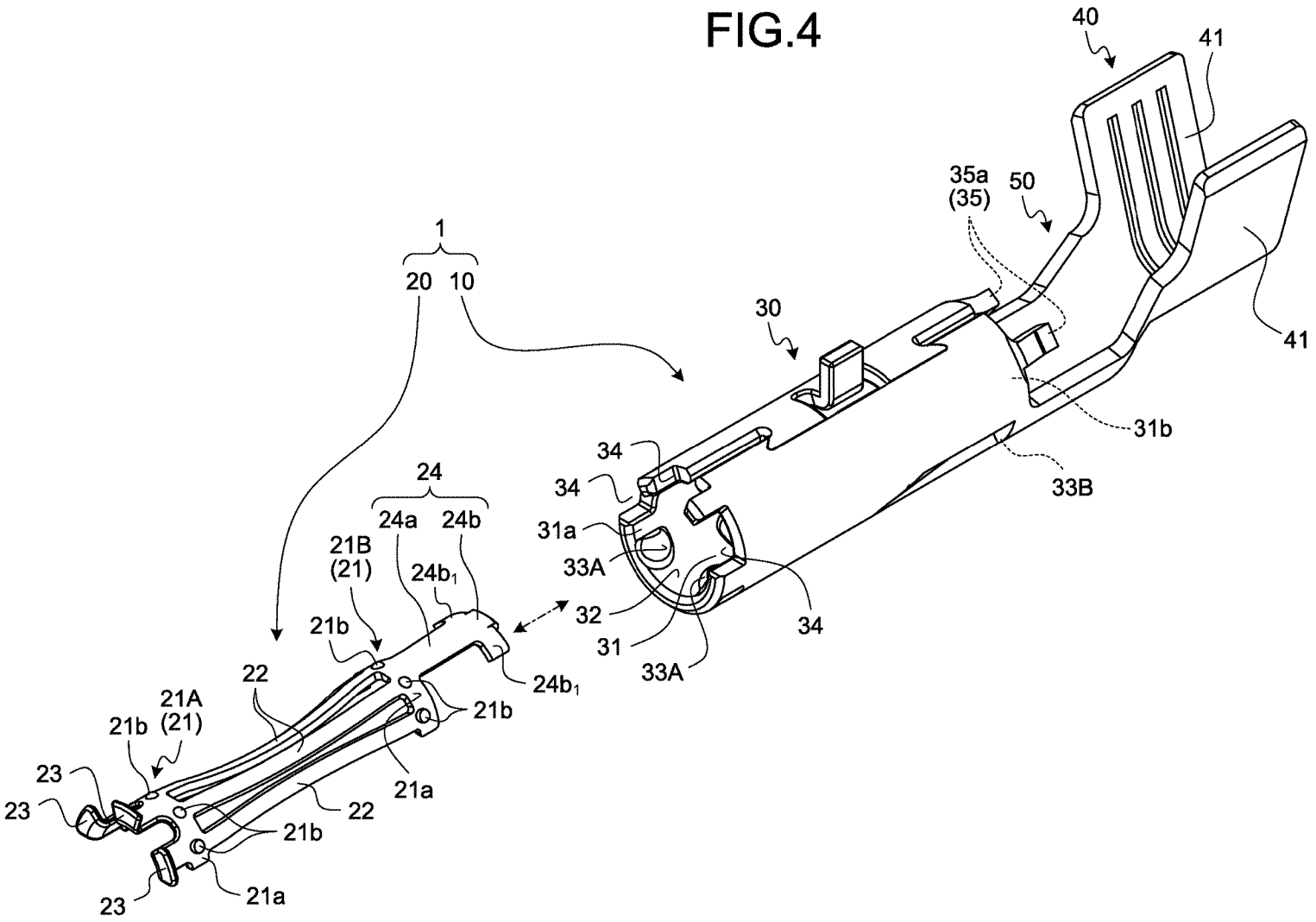
FIG. 4 is an exploded perspective view illustrating the connection terminal according to the embodiment.

The second locked body 24 is a part protruding from the end portion (the second female-side contact portion 21B) of the contact member 20 arranged on the second opening 31*b* side toward the male terminal insertion direction (the insertion direction of the contact member 20 into the internal space 31). The second locked body 24 is formed in a T shape having a shaft portion 24*a* protruding from the second female-side contact portion 21B and an arcuate portion 24*b* provided at an end portion of the shaft portion 24*a* on a side of a protruding direction (FIGS. 1, 3 and 6). The shaft portion 24*a* is inclined outward in the radial direction with the second female-side contact portion 21B as a starting point such that the arcuate portion 24*b* side thereof is arranged outward in the radial direction as compared to the second female-side contact portion 21B side thereof. The shaft portion 24*a* may have elasticity in the radial direction of the female connection body 30. In addition, the arcuate portion 24*b* has the two piece portions 24$b_1$, as the locked portions, each of which protrudes in the circumferential direction with the shaft portion 24*a* as a starting point.

The second locking body 35 is a part protruding from the end portion on the second opening 31*b* side of the female connection body 30 toward the male terminal insertion direction. The second locking body 35 protrudes toward the piece portion 24$b_1$ of the second locked body 24 in the accommodated contact member 20 and is arranged to oppose the piece portion 24$b_1$ in the male terminal insertion/removal direction. An end portion on a side in a protruding direction of the second locking body 35, the portion arranged to oppose the piece portion 24$b_1$ in the male terminal insertion/removal direction, is used as the locking portion 35*a*. The two second locking bodies 35 are provided, respectively, for the piece portions 24$b_1$ and are provided with an interval in the circumferential direction from the end portion on the second opening 31*b* side of the female connection body 30.

The piece portion 24$b_1$ of the second locked body 24 and the second locking body 35 may be in contact with each other or may be provided with an interval therebetween in the state where the contact member 20 is completely accommodated in the internal space 31. The interval corresponds to a relative movement amount of the piece portion 24$b_1$ of the second locked body 24 at the completely accommodated position until being locked by the second locking body 35, and is set such that the relative movement amount is within an allowable value. The allowable value may be determined among values of the relative movement amount of the piece portion 24$b_1$ of the second locked body 24 within a range in which the electrical connection state between the contact member 20 and each of the female connection body 30 and the male connection body Tm1 is not inhibited, and for example, is set to a maximum value of the relative movement amount.

In the second locking structure 62, the shaft portion 24*a* of the second locked body 24 is arranged between the two second locking bodies 35 and the two second locking bodies 35 and the shaft portion 24*a* are oppositely arranged in the circumferential direction of the female connection body 30 in the state where the contact member 20 is completely accommodated in the internal space 31. In such an oppositely arranged state, the piece portion 24$b_1$ as the locked portion of the second locked body 24 and the locking portion 35*a* of the second locking body 35 are oppositely arranged in the male terminal insertion/removal direction in the second locking structure 62. Therefore, the second locking structure 62 can suppress the relative displacement of the contact member 20 with respect to the female connection body 30 in the removal direction.

As described above, the connection terminal 1 according to the present embodiment can improve the insertion workability at the time of attaching the contact member 20 to the terminal main body 10 by the second bulging body 33B, and to improve the insertion workability at the time of inserting the male connection body Tm1 into the female connection body 30.

The connection terminal according to the present embodiment can improve the insertion workability at the time of attaching the contact member to a terminal main body by a second bulging body, and improve the insertion workability at the time of inserting the male connection body into a female connection body.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connection terminal comprising:

a conductive terminal main body that includes a female connection body provided with a columnar internal space into which a male connection body of a mating male terminal is inserted, and a wire connection body to which a conducting portion of an electric wire is electrically connected; and a contact member that is arranged to oppose an inner circumferential surface of the female connection body in one region of the internal space partitioned into two regions along an insertion/removal direction of the male connection body, is electrically connected to the female connection body on the inner circumferential surface of the female connection body, and is electrically connected to the male connection body inserted into the internal space from a first opening of the female connection body, wherein a first bulging body and a second bulging body each of which protrudes from the inner circumferential surface of the female connection body and is electrically connected to the male connection body by sandwiching the male connection body, completely accommodated in the internal space, with the contact member are provided, respectively, on a side of the first opening and a side of a second opening in the other region of the partitioned internal space, the second bulging body has a first guide portion capable of guiding the male connection body while sliding the male connection body in a process of inserting the male connection body into the internal space, and a second guide portion capable of guiding the contact member while sliding the contact member in a process of inserting the contact member into the internal space from the first opening, and each of the first guide portion and the second guide portion is formed in a tapered shape so as to have an interval with respect to the one region of the partitioned internal space that is larger on the first opening side than on the second opening side.

2. The connection terminal according to claim 1, wherein the first bulging body and the second bulging body are arranged two by two at intervals in a circumferential direction of the inner circumferential surface of the female connection body.

3. The connection terminal according to claim 1, wherein the contact member includes first and second female-side contact portions which are arranged to be spaced apart from each other in the insertion/removal direction and are electrically connected to the inner circumferential surface of the female connection body, and a male-side contact portion that couples the first and second female-side contact portions and is electrically connected to the male connection body inserted into the internal space.

4. The connection terminal according to claim 2, wherein the contact member includes first and second female-side contact portions which are arranged to be spaced apart from each other in the insertion/removal direction and are electrically connected to the inner circumferential surface of the female connection body, and a male-side contact portion that couples the first and second female-side contact portions and is electrically connected to the male connection body inserted into the internal space.

* * * * *